US005120045A

United States Patent [19]

Kamezaki et al.

[11] Patent Number: 5,120,045

[45] Date of Patent: Jun. 9, 1992

[54] ATTACHING STRUCTURE FOR A REMOVABLE SHEET HOLDING TRAY

[75] Inventors: Yasushi Kamezaki, Sakai; Katsunori Masai, Amagasaki, both of Japan

[73] Assignee: Mita Industrial Co., Ltd., Osaka, Japan

[21] Appl. No.: 678,558

[22] Filed: Mar. 28, 1991

Related U.S. Application Data

[62] Division of Ser. No. 438,130, Nov. 16, 1989.

[30] Foreign Application Priority Data

Nov. 24, 1988 [JP] Japan ..... 63-152793[U]
Nov. 24, 1988 [JP] Japan ..... 63-296531

[51] Int. Cl.[5] ..... B65H 1/00; B65H 31/22

[52] U.S. Cl. ..... 271/162; 271/213; 16/259; 16/262

[58] Field of Search ..... 271/145, 162, 213; 16/259, 262, 321

[56] References Cited

U.S. PATENT DOCUMENTS 2,448,580 9/1948 Crosby ..... 16/259
3,352,613 11/1967 Morris et al. ..... 16/259
3,510,124 5/1970 Bentzman ..... 271/162
4,722,157 2/1988 Parry ..... 16/262

FOREIGN PATENT DOCUMENTS 41348 2/1988 Japan ..... 271/213
56354 2/1990 Japan ..... 271/213

*Primary Examiner*—Robert P. Olszewski
*Assistant Examiner*—Steven M. Reiss
*Attorney, Agent, or Firm*—Jordan and Hamburg

[57] ABSTRACT

A sheet transport device is provided which has a sheet tray removably attachable to the body of an apparatus pivotally movably to an upright position or an unfolded position. The sheet tray has pivots projecting from the respective opposite sides of base end of the tray and each having a first width when the tray is in the upright position and a second width larger than the first width when the tray is in the unfolded position. The apparatus body has cutouts for the respective pivots, each having an inlet portion with a width larger than the first width and smaller than the second width and a support portion with a diameter not smaller than the second width. An elastic member is disposed close to at least one of the cutouts for restraining the pivot as positioned in the support portion from rotating from the unfolded position to the upright position by contacting the pivot.

17 Claims, 15 Drawing Sheets

ATTACHING STRUCTURE FOR A REMOVABLE SHEET HOLDING TRAY

This is a division, of allowed application Ser. No. 07/438,130, filed Nov. 16, 1989.

BACKGROUND OF THE INVENTION AND RELATED ART STATEMENT

The present invention relates to sheet transport devices for use in copying machines, automatic document feeders or the like, and more particularly to a device which comprises a removable, sheet guide member for guiding copy paper, document or like sheet for transport to a separating roller, or in which a sheet tray such as paper feed tray or discharge tray is removably provided.

Image forming apparatus such as copying machines or automatic document feeders for use in such image forming apparatus include a sheet transport device for feeding or discharging copy paper, documents or like sheets. The paper feed assembly of such a device generally comprises a document tray, paper feed roller, separating roller for preventing feed of more than one sheet, guide member for documents and the like (for example, as in the automatic document feeder disclosed in Unexamined Japanese Utility Model Publication SHO 60-167033).

FIG. 11 shows an example of paper feed assembly. With reference to this drawing, indicated at 101 is a main housing, at 102 a feed housing comprising a cover 102*a* and a bottom plate 102*b*. A pair of register rollers 103, a conveyor belt 104, etc. are arranged within the main housing 101. Disposed inside the feed housing 102 are a feed roller 105, separating roller 106, dispenser roller 107, etc. The feed roller 105 and the separating roller 106 are rotatably supported by unillustrated bearings on the feed housing 102. The feed roller 105 is driven in the direction of feed of documents, while the separating roller 106 is driven in the opposite direction, whereby double sheet feeding is prevented.

A document tray 108 is attached to the upstream-side end portion of the paper feed assembly. A document guide member 109 is provided between and adjacent to the document tray 108 and the conveyor belt 104. The document guide member 109 is so shaped as to cover the rotary shaft 106*a* of the separating roller 106 except the upper portion of the roller 106 and is fastened to the bottom plate 102*b* with screws for passing the document over the separating roller 106 toward the pair of register rollers 103.

The document tray 108 has its base portion attached to each side plate 102*c* extending upward from the bottom plate 102*b* with a pin 110 inserted from one side, whereby the tray 108 is made pivotally movable about the pin 110. Accordingly, documents can be placed on the tray 108 as unfolded to the solid-line position in FIG. 11, while when the tray 108 is in an upright position indicated in phantom lines in the drawing, the user can readily use a manual feed tray below the tray 108 or handle a paper cassette below the tray 108. The structure is usable, for example, for attaching a document delivery tray to the downstream-side end of the automatic document feeder or for attaching a copy paper manual feed tray or discharge tray to the body of the copying machine.

However, the conventional structure described has the following problems to be solved.

First with the above structure, the position of the separating roller 106 and the document guide member 109 relative to each other, especially the amount of projection of the roller 106 beyond the guide member 109 and the parallelism of these members become very important in enabling the separating roller 106 to effectively separate sheets of paper. Nevertheless, since the separating roller 106 and the guide member 109 are attached to the feed housing 102 individually independently of each other, the errors involved in the attachment directly influence the position of them relative to each other, making it difficult to position them accurately relative to each other. Especially because the guide member 109 is generally made of resin or like flexible member and is therefore prone to warping or distortion due to external conditions such as temperature, the two members can not always be held in a definite position relative to each other after assembling.

Further with the above structure, the document tray 108 needs to be attached to or removed from the automatic document feeder by inserting the pins 110 into the feeder or removing the pins therefrom at the front and rear sides of the feeder. Especially it is cumbersome to handle the pin 110 on the rear side of the feeder, for example, for maintenance. It is therefore desired to make the tray 108 attachable or removable more easily.

Since the automatic document feeder is made openable (pivotally movable) relative to the body of image forming apparatus, it is required that the feeder be attached to the body with good stability without the likelihood that the document tray will fall off when the feeder is opened or closed. Such an attachment problem is encountered, for example, with other sheet trays for use as attached to apparatus the body of which is openable, like the manual feed tray for copying machines of the clamshell type.

SUMMARY OF THE INVENTION

The main object of the present invention is to provide a sheet transport device free of the above problems.

To fulfill the above object, the present invention provides a device comprising a separating roller drivingly rotatable in a direction opposite to the direction of transport of sheets, bearings for rotatably supporting the rotary shaft of the separating roller, and a sheet guide member for guiding the sheet to the separating roller, the sheet guide member being provided with a fitting portion fittable to each of the bearings from a direction approximately perpendicular to the axis of the bearing, the sheet guide member being attachable to a paper feeder by the fitting of the fitting portion to the bearing.

With the device described above, the sheet guide member is fitted to the bearings for the separating roller, whereby the guide member and the roller can be held in a specified position relative to each other. Accordingly, the sheet guide member and the separating roller can be fixed in position relative to each other easily and properly by a simple construction. This leads to the advantage of enabling the separating roller to reliably prevent double sheet feeding almost without being influenced, for example, by the deformation of the sheet guide member and the accuracy with which the member and the roller are installed.

The present invention further provides a sheet transport device having a sheet tray removably attachable to the body of an apparatus pivotally movably to an upright position or an unfolded position, the sheet tray having pivots projecting from the respective opposite sides of the base end of the sheet tray and each having a first width when the sheet tray is in the upright position and a second width larger than the first width when the sheet tray is in the unfolded position, the apparatus body having cutouts opened for the respective pivots, each of the cutouts having an inlet portion having a width larger than the first width and smaller than the second width and a support portion having a diameter not smaller than the second width, an elastic member being provided in the vicinity of at least one of the cutouts for restraining the pivot as positioned in the support portion from rotating from the unfolded position to the upright position by contacting the pivot.

With this structure, the sheet tray is first brought to the upright position so that the pivot has the first width, and the pivot is then inserted into the cutout from above and fitted into the support portion. The sheet tray is thereafter moved to the unfolded position so that the pivot has the second width and is prevented from slipping off outward through the outlet portion. The elastic member is in bearing contact with the pivot in this state, restraining the sheet tray from moving from the unfolded position to the upright position, for example, when the body of the apparatus is opened or closed.

Accordingly, the structure described, although simple, has the advantage that the sheet tray can be attached removably and pivotally movably, merely by the simple procedure of inserting the pivots on the tray in its upright position into the cutouts and moving the tray to the unfolded position.

Moreover, the sheet tray is restrained from moving from the unfolded position to the upright position by the contact of the elastic member with the pivot as positioned in the support portion. This prevents the sheet tray from easily moving during opening or closing of the apparatus body, permitting the sheet tray to be held installed in place with good stability.

The above and other objects, features and advantages of the present invention will become apparent from the following description with reference to the accompanying drawings.

BRIEF DESCRIPTION OF THE DRAWINGS

FIG. 4 (*b*) is a view in section taken along the line B—B in FIG. 3;

DESCRIPTION OF THE PREFERRED EMBODIMENTS

Embodiments of the invention will be described with reference to FIGS. 1 to 10.

Figure 10:
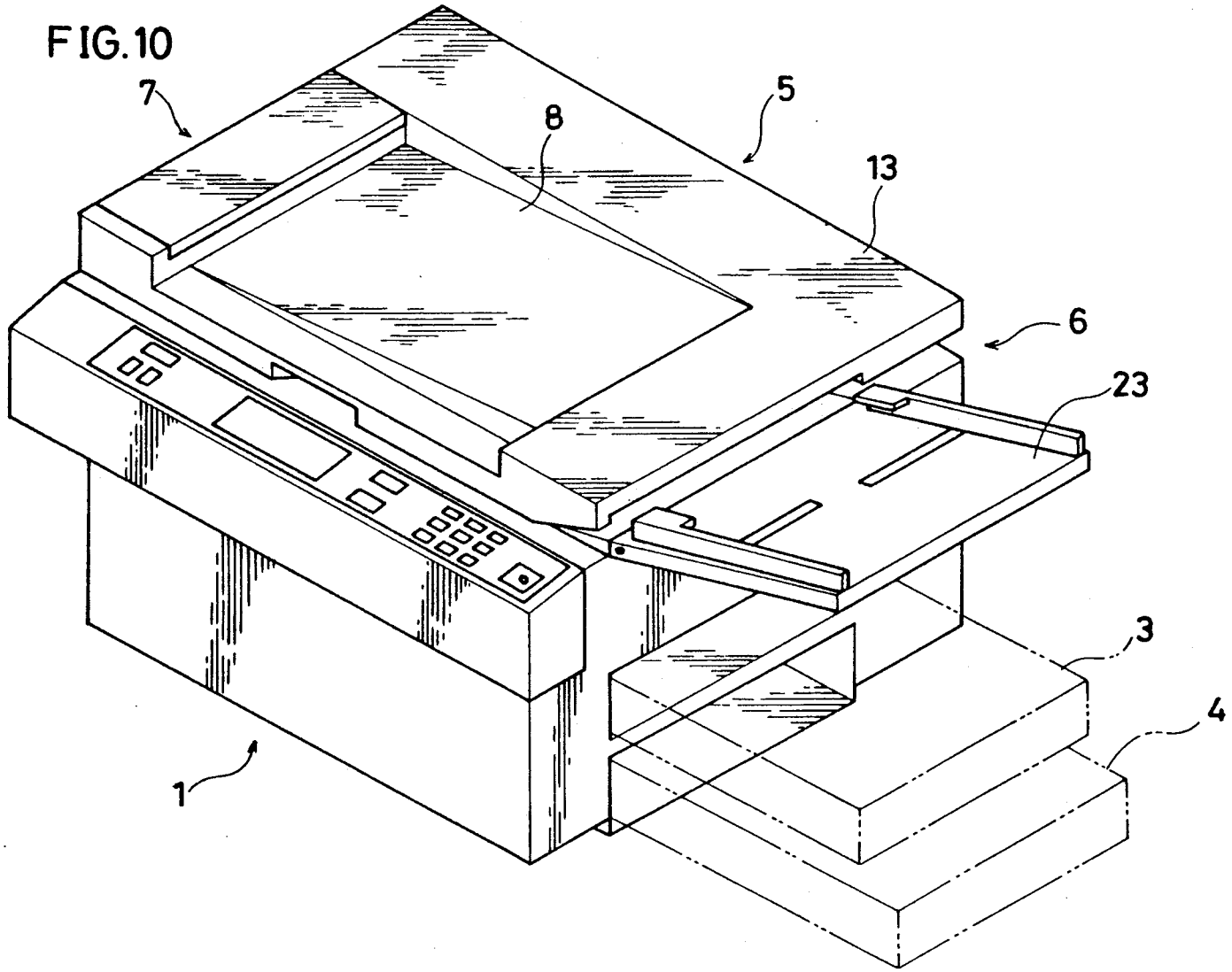
FIG. 10 is a perspective view showing the appearance of the feeder and the body of a copying machine.
Figure 11:
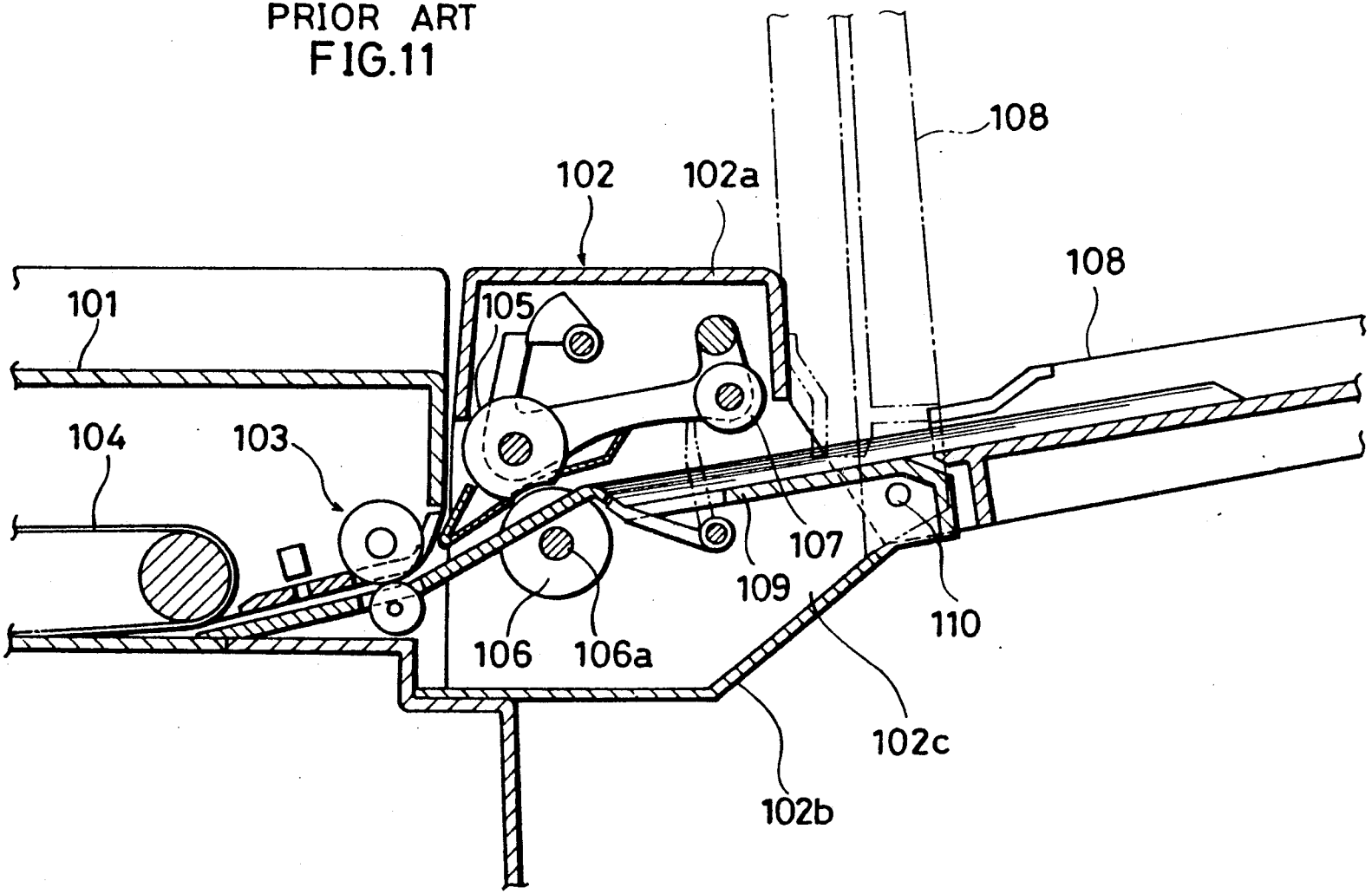
PRIOR ART FIG.11
FIG. 11 is a sectional view showing a part of a conventional automatic document feeder.

FIG. 10 shows the body 1 of a copying machine. The machine body 10 has on its top a contact glass plate 2 (see FIG. 1). An image of a document placed on the glass plate 2 is formed on paper supplied from a paper cassette 3 or 4, and the copy obtained is delivered onto an unillustrated discharge tray.

An automatic document feeder 5 is placed on the top of the machine body 1. The feeder 5 has a paper feed assembly 6 at its one end, a document delivery portion 7 at the other end thereof, and a conveyor belt 10 (FIG. 1) above the contact glass plate 2. The feeder 5 causes the feed assembly 6 to feed documents (sheets) one by one onto the glass plate 2. Each document copied is transported upward by the belt 10 and the delivery portion 7 and delivered onto a document discharge portion 8 on the upper side of the feeder.

Figure 1:
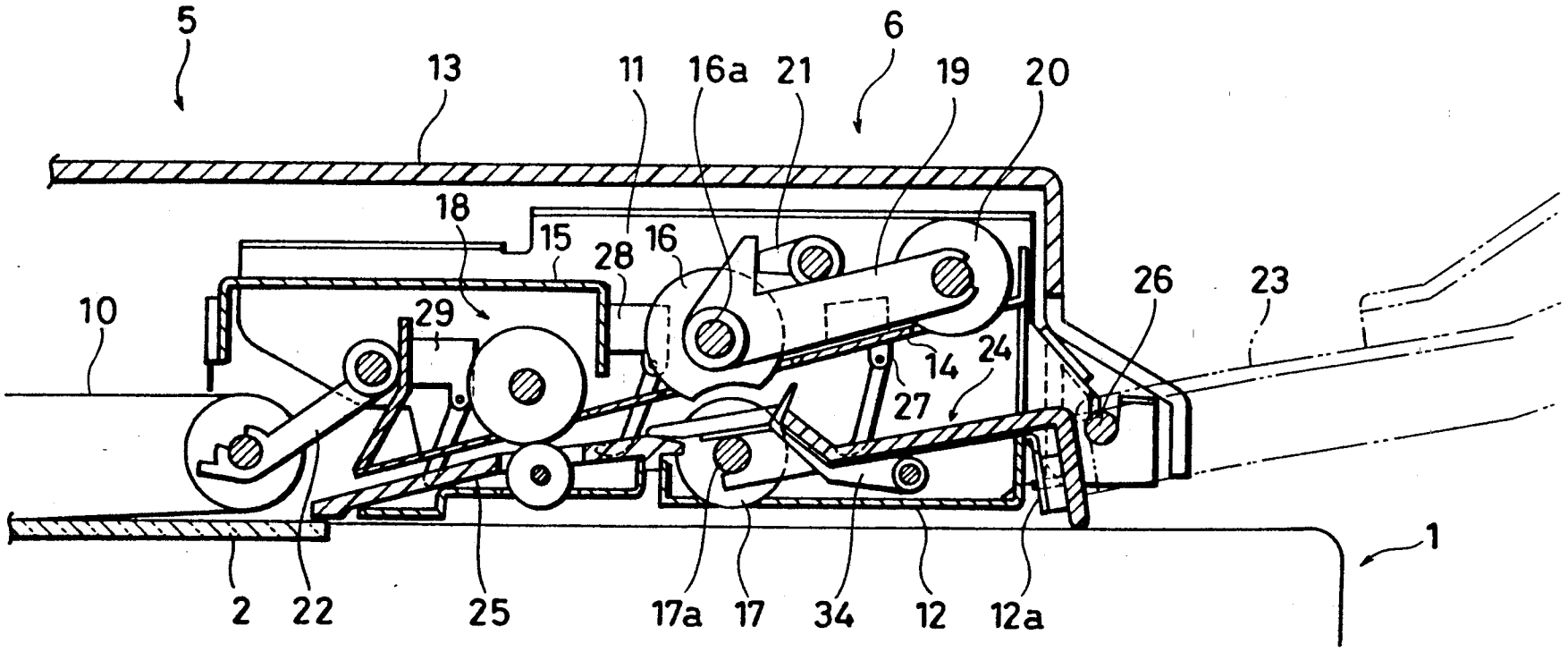
FIG. 1 is a sectional view showing a part of an automatic document feeder embodying the present invention.

FIG. 1 shows the interior construction of the paper feed assembly 6, which has a box-shaped housing comprising a pair of side plates 11 and a bottom plate 12. The assembly 6 is accommodated in a cover 13 along with the document delivery portion 7. A mount guide plate 14 and a mount plate 15 are arranged above the bottom plate 12.

Accommodated in the housing are a feed roller 16 and a separating roller 17 below the roller 16. A pair of register rollers 18 is disposed downstream from these rollers. The rotary shafts of the rollers are rotatably supported at their opposite ends by the respective side plates 11. The rotary, shaft 16*a* of the feed roller 16 has attached thereto arms 19 pivotally movable about the shaft 16*a* and rotatably carrying at their forward ends a forwarding roller 20. A cam 21 disposed close to the arm 19 pivotally moves the arms 19 when rotated.

The cam 21, the feed roller 16 and the separating roller 17 are coupled to a drive source (not shown). The drive source drives the feed roller 16 and the separating roller 17 clockwise in FIG. 1 and causes the arms 19 to perform a stroke of pivotal reciprocating movement during one turn of rotation of the feed roller 16.

On the other hand, the feed assembly 6 has a document tray (sheet tray) 23, document guide member (sheet guide member) 24 and document guide plate 25 arranged toward the direction of transport of documents and serving as document guides.

The document tray 23 is attached to the side plates 11 movably about pivots 26 on opposite sides of its base end. The document guide member 24 extends over an area from the base end of the tray 23 to the downstream side of the feed roller 16 and the separating roller 17. The document guide 25 is provided over an area from the downstream end of the guide member 24 to a position on the glass plate 2 and fixedly fitted to the bottom plate 12.

A document insertion sensor 27 is disposed at the upstream side of the feed roller 16 and the separating roller 17. A document size sensor 28 is similarly disposed at the upstream side of the pair of register rollers 18, and a document passage sensor 29 at the upstream side of the glass plate 2. The document insertion sensor 27 is turned on when the document placed on the tray 23 is inserted to a predetermined position on the guide member 24. The document passage sensor 29 detects the passage of the leading end of the document forwarded by the register rollers 18 by a secondary feed operation. Upon the lapse of a predetermined period of time after the detection, the conveyor belt 10 is halted, whereby the fed document is positioned as specified. The size sensor 28 is disposed at a a position a predetermined distance away from the position of the center of the document to be fed and is turned on only when a document not smaller than a specified size (e.g. B4 size) has passed.

Indicated at 22 in FIG. 1 is a connecting arm for positioning the body of the feed assembly 6 and the conveyor belt 10 relative to each other.

Next, a description will be given of the structure for supporting the separating roller 17, the configuration of the document guide member 24 and the structure for supporting the member 24 with reference to FIGS. 2 to 4.

Figure 2:
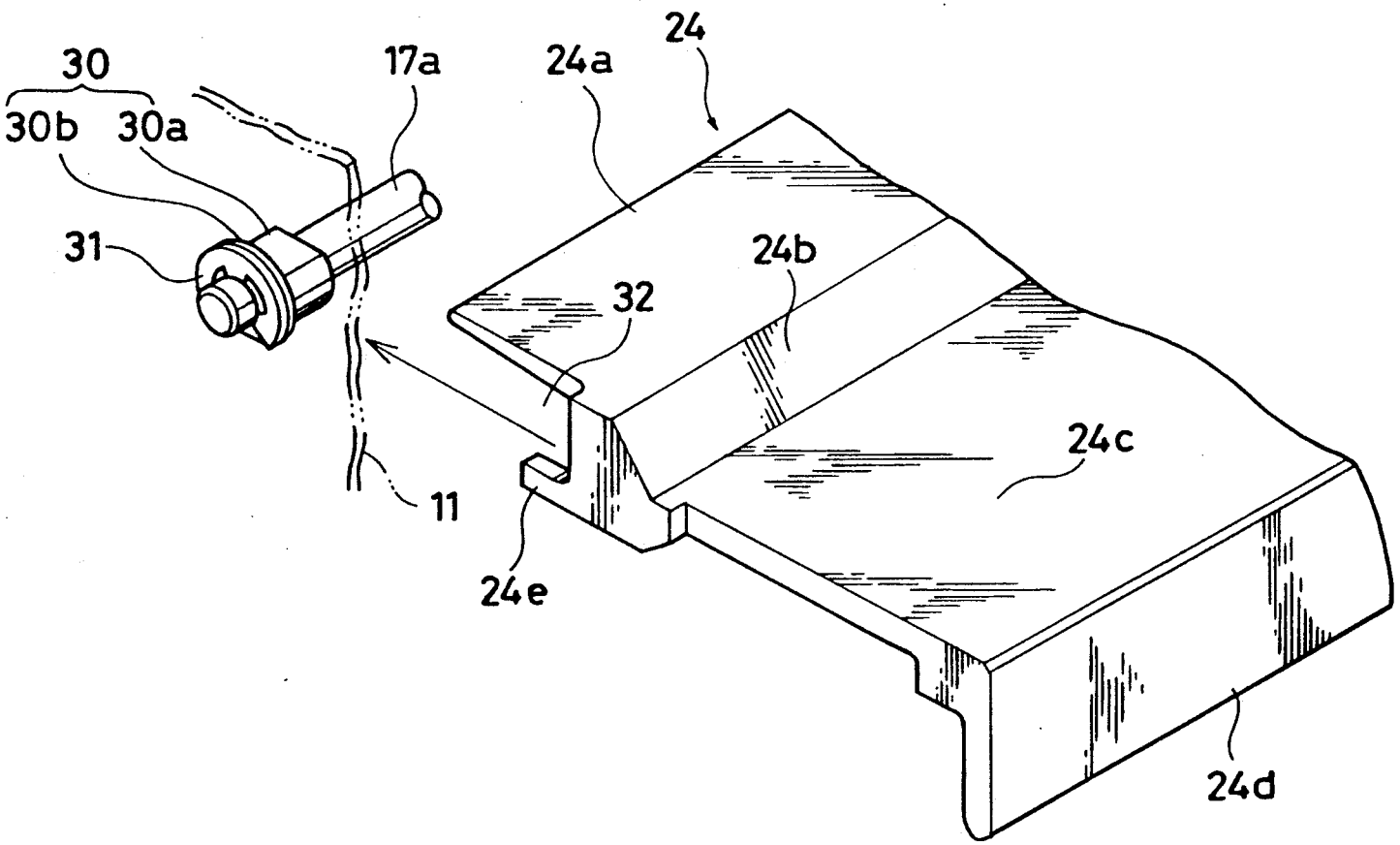
FIG. 2 is a perspective view of a structure for attaching a document guide member and a separating roller to the feeder.

Bearings 30 for the separating roller 17 are attached to the respective side plate 11 as seen in FIG. 2. Each of the bearings 30 comprises a stem 30*a* in the form of a hollow cylinder cut out at the upper and lower portions of its periphery, and a flange 30*b* in the form of an annular disk and is fitted from outside in a mount hole in the form of an elongated circle and formed in the side plate 11. The rotary shaft 17*a* of the separating roller 17 is rotatably supported by the bearing 30. An E-shaped retaining ring 31 is attached to each end of the shaft 17*a*, whereby the shaft 17*a* is positioned in place axially thereof.

The document guide member 24 comprises a document guide portion 24*a*, slanting portion 24*b*, document stacking portion 24*c*, and straight extension 24*d* extending downward from the stacking portion and has such a width that the member 24 can be accommodated in the space between the opposed side plates 11. The document guide portion 24*a* is formed at each side thereof with a projecting portion 24*e* extending in the direction of transport of the document. The projecting portion 24*e* and the guide portion 24*a* provide a U-shaped fitting portion 32 approximately in conformity with the contour of the bearing stem 30*a*.

Figure 3:
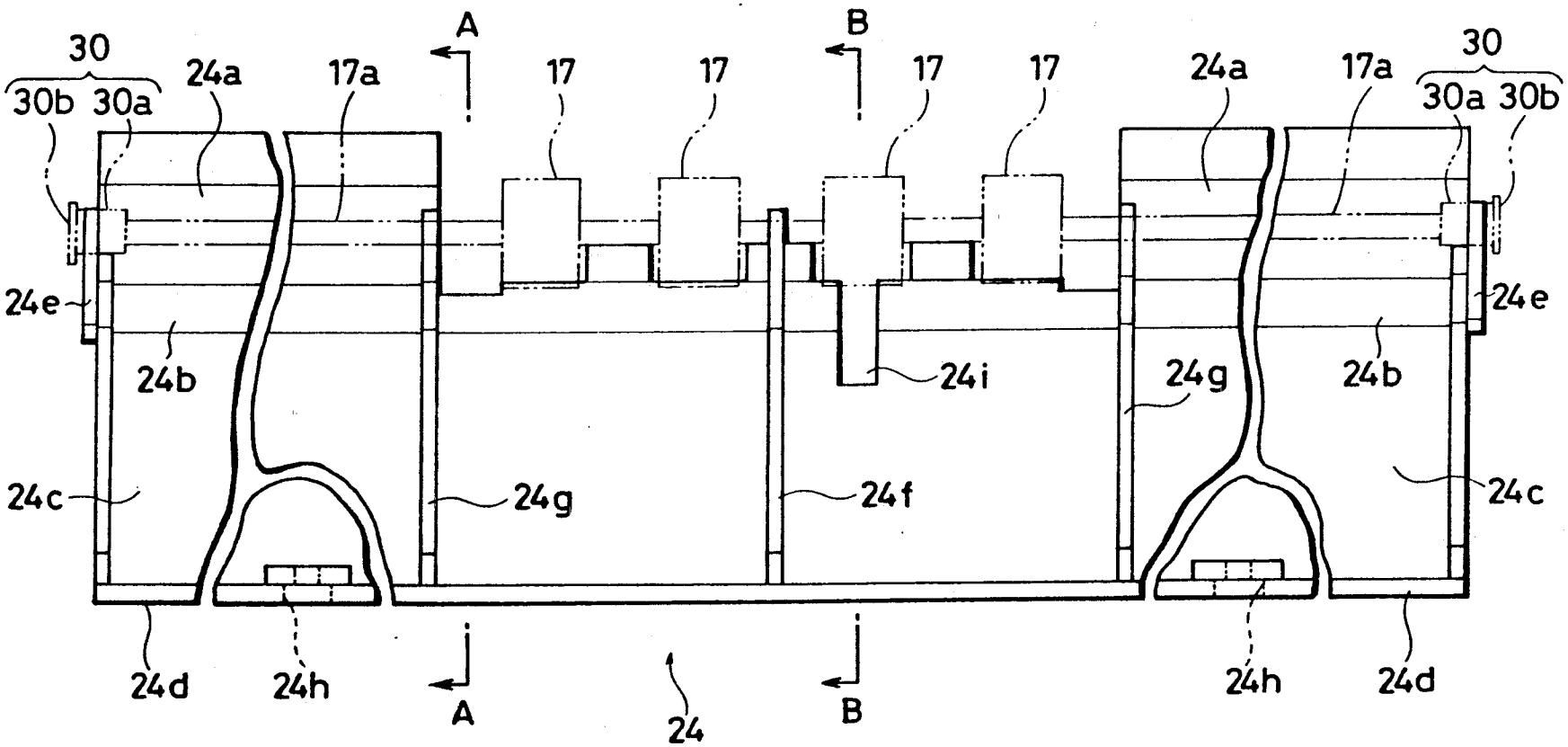
FIG. 3 is a bottom view of the document guide member.
Figure 4B:
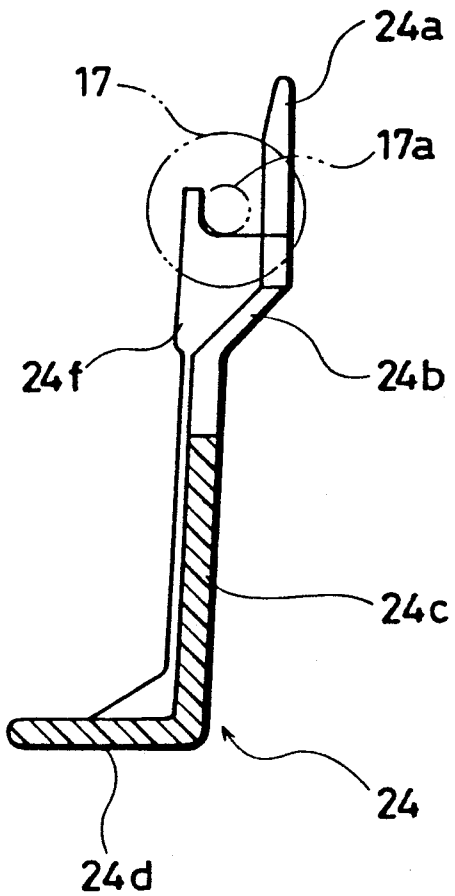
FIG. 4 (*a*) is a view in section taken along the line A—A in FIG. 3.
Figure 4A:
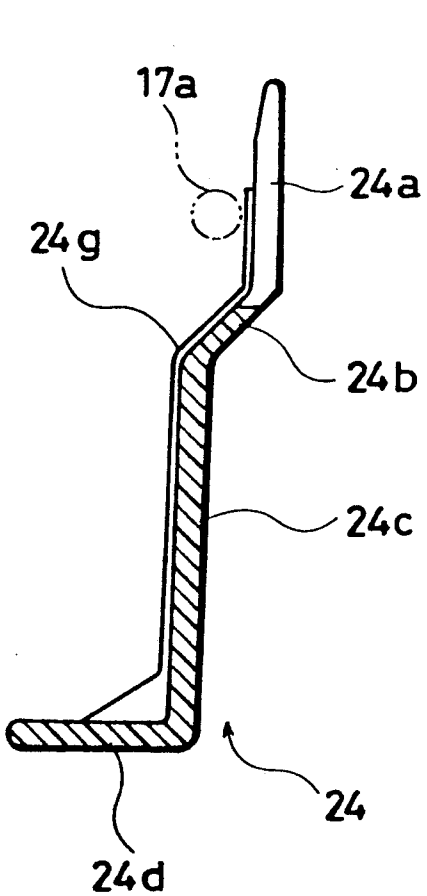

With reference to FIG. 3, the document guide member 24 is formed on the rear side thereof with a rib 24*f* at the center and ribs 24*g* at the respective opposite sides thereof. The rib 24*f* is so shaped as to contact the periphery of the rotary shaft 17*a* from one side and below (from below and from the left side in FIG. 4 (*b*)), while the ribs 24*g* are so shaped as to substantially contact the periphery of the shaft 17*a* from above (from the right side in FIG. 4 (*a*)).

As seen in FIG. 3, mount holes 24*h* are formed in the straight extension 24*d* of the guide member 24 at specified positions. The bottom plate 12 has a mount plate 12*a* (FIG. 1) opposed to the straight extension 24*d* and formed with screw holes approximately in alignment with the respective holes 24*h*.

The fitting portions 32 are fitted to the respective bearings 30 of the separating roller 17 from a direction (generally from the right in FIG. 1) perpendicular to the axis thereof, whereby the document guide member 24 is positioned in place relative to the separating roller 17 with respect to the vertical and horizontal directions. In this state, screws 33 are driven through the holes 24*h* into the, screw holes in the mount plate 12*a*, whereby the guide member 24 is attached to the bottom plate 12.

When the guide member 24 is installed in place, the document guide portion 24*a* covers the rotary shaft 17*a* of the separating roller 17 from above, with the roller 17 projecting beyond the guide portion 24*a* by a predetermined amount. The document tray 23 is restrained by the straight extension 24*d* from moving clockwise in FIG. 1. With the tray 23 moved clockwise to the limit position, the upper surface of the tray 23 is approximately flush with the upper surface of the document stacking portion 24*c*.

Indicated at 24*i* in FIG. 3 is a cutout for permitting the passage of a lever of the document insertion sensor 27.

The paper feed assembly 6 having the document guide member 24 thus installed in place operates in the following manner. When a document is placed on the document tray 23 and inserted to such a position that the leading end of the document comes into contact with the projecting end of a document stopper 34 provided in the assembly 6, the document insertion sensor 27 is turned on to bring the automatic document feeder into operation.

Next, a document feed button, is depressed, whereby the stopper 34 is pivotally moved to retract its end downward from the guide member 24. At the same time, the cam 21 rotates, moving the arms 19 and lowering the forwarding roller 20 onto the document. The forward-ing roller 20 and the feed roller 16 rotate to bring the document into contact with the pair of register rollers 18 for a primary feed operation. At the same time, the separating roller 17 rotates in a direction opposite to the direction of transport of the document, whereby double sheet feeding is prevented. The primary feeding operation is followed by a secondary feeding operation by the rotation of the register rollers 18. The document is transported to the specified position on the contact glass plate 2 by the conveyor belt 10.

In the operation described above, the effect of the separating roller 17 to prevent double sheet feeding is greatly influenced by the position of the separating roller 17 and the document guide member 24 relative to each other, especially the amount of projection of the roller 17 beyond the guide portion 24*a* and the parallelism of the roller 17 and the member 24. However, since the roller 17 and the guide member 24 are positioned properly relative to each other by the fitting of the member 24 with the bearings 30 of the roller 17, the double feed preventing, effect can be achieved more reliably than in the prior art in which the separating roller and the document guide member are installed individually.

The document guide member 24 and the separating roller 17 are fixedly positioned relative to each other even if the guide member 24 warps or becomes distorted or otherwise deformed after the paper feed assembly 6 has been assembled. This assures the double sheet feed preventing effect. Further when the document guide member 24 is engaged at their intermediate portions with the separating roller shaft 17*a* by the ribs 24*f*, 24*g* as in the present embodiment, the guide member 24 can be forced to retain its shape against deformation, utilizing the rigidity of the rotary shaft 17*a*, hence the advantage of diminishing the influence due to the deformation.

The document guide member 24 can be installed merely by engaging the fitting portions 32 with the respective bearings 30 and fastening the straight extension 24*d* to the mount plate 12*a* with screws. This procedure is very simple, making the assembly easy to maintain. Further when the document feeder 5 need not be portable, the screws can be dispensed with.

Although the present embodiment has been described as a structure for attaching the document guide member 24 to the automatic document feeder 5, the invention is useful for attaching a sheet guide member to various paper feed devices. For example, the above advantages can be similarly obtained when the present structure is used for attaching a copy paper guide member to a paper feeder in the body of a copying machine.

Next, the structure for attaching the document tray 23 to the paper feed assembly 6 of the automatic document feeder 5 will be described with reference to FIGS. 5 to 8.

Figure 6:
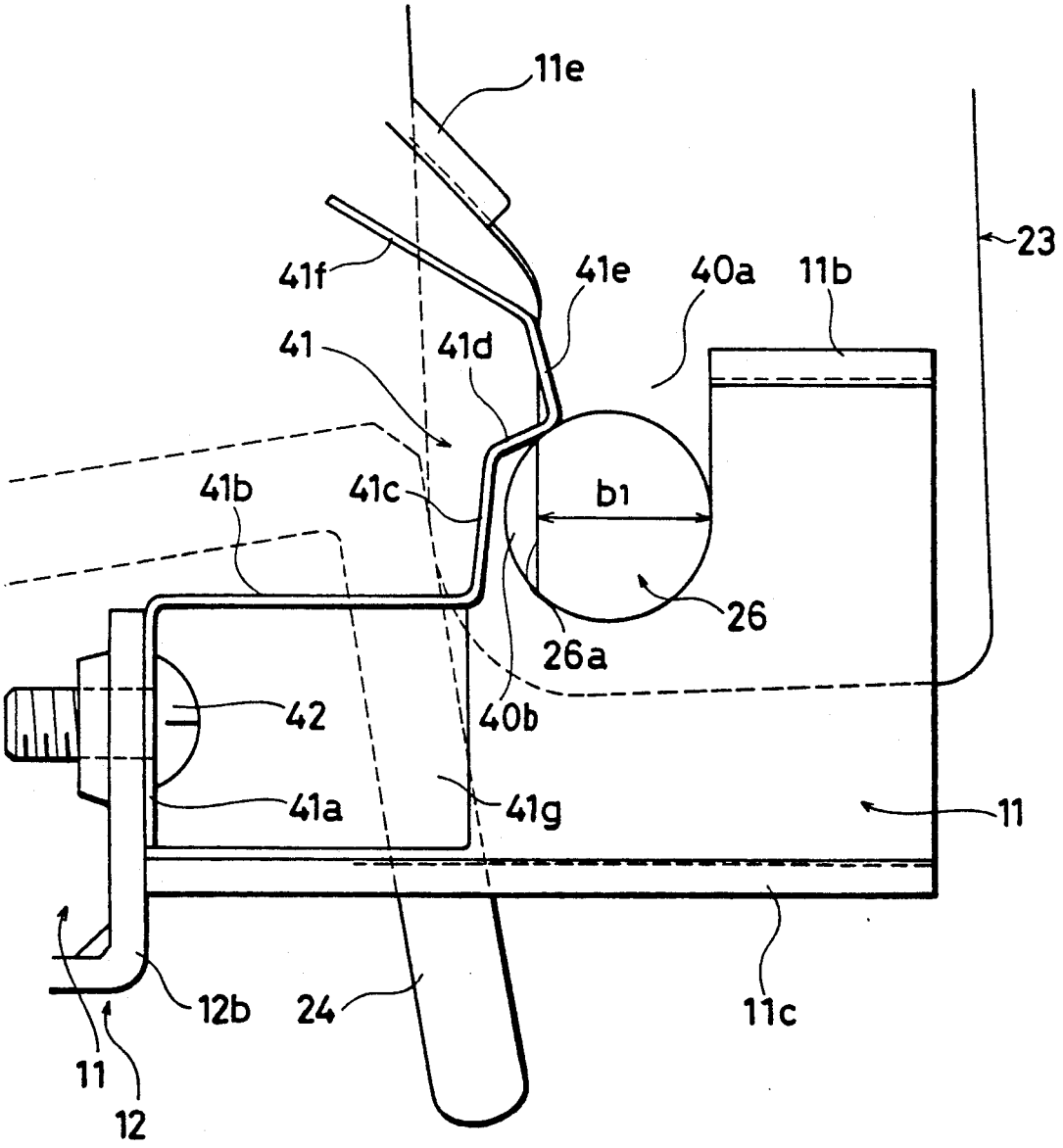
FIGS. 6 to 8 are fragmentary front views of the structure.
Figure 8:
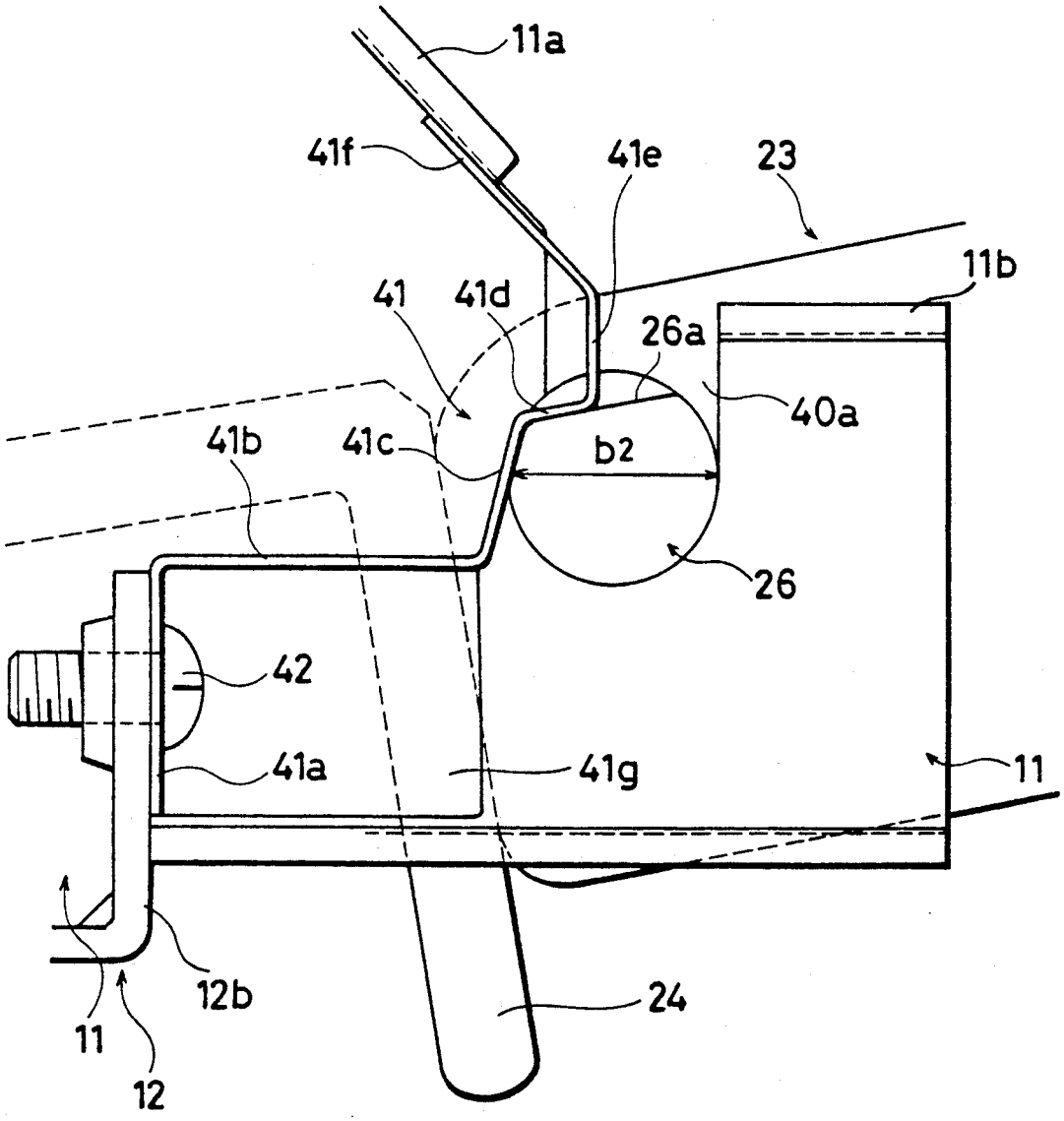
Figure 9:
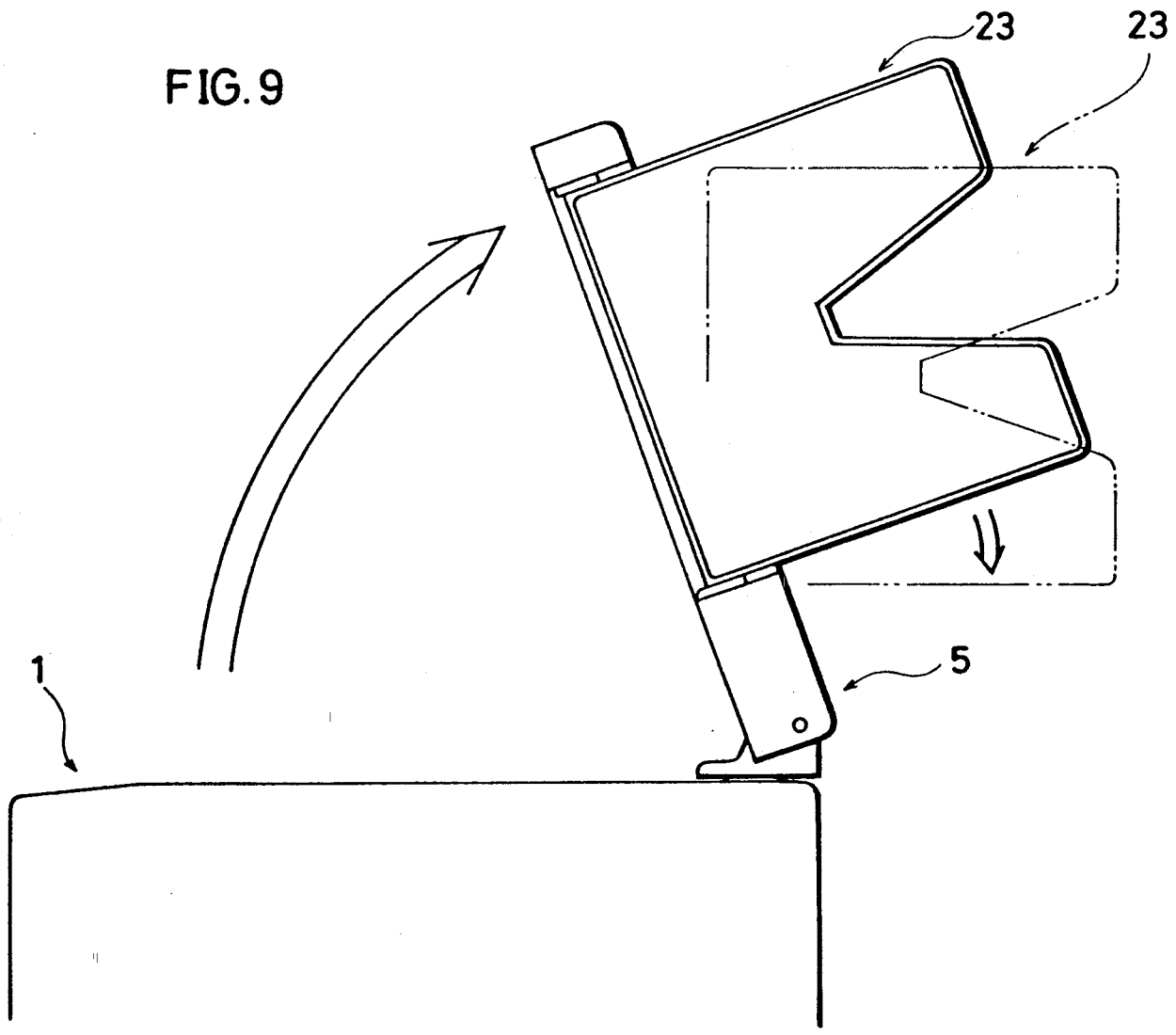
FIG. 9 is a side elevation showing the feeder as opened.

The pair of pivots 26 are provided on the respective opposite sides of the base end of the document tray 23. The end portion of each pivot 26 projecting from the side face of the tray 23 is partly cut out to form a D-cut face (cutout face) 26*a*. More specifically, the pivot end portion is so shaped in cross section as to have a first width bl smaller than the diameter of the pivot 26 when the tray 23 is in an upright position as seen in FIG. 6 and a second width b2 equal to the diameter of the pivot 26 when the tray 23 is in an unfolded position as shown in FIG. 8.

An upwardly open cutout 40 for the pivot 26 is formed in the upstream end portion of each of the opposed side plates 11. The cutout 40 has a straight inlet portion 40*a* with a width slightly larger than the first width bl, and a circular support portion 40*b* with a diameter equal to or slightly larger than the second width b2.

Indicated at ll*a* to ll*c* are ribs formed along edges of the side plate 11.

A plate spring (elastic member) 41 is provided in the vicinity of one of the cutouts 40 which is formed at the front side of the feeder. The plate spring 41 is bent at five portions and has a base portion 41*a*, horizontal portion 41*b*, first upright portion 41*c*, rotation restraining portion 41*d*, second upright portion 41*e*, and an engaged portion 41*f* which are arranged one after another. The plate spring 41 also has a portion 41*g* for restraining the deflection of the horizontal portion 41*b*.

Figure 5:
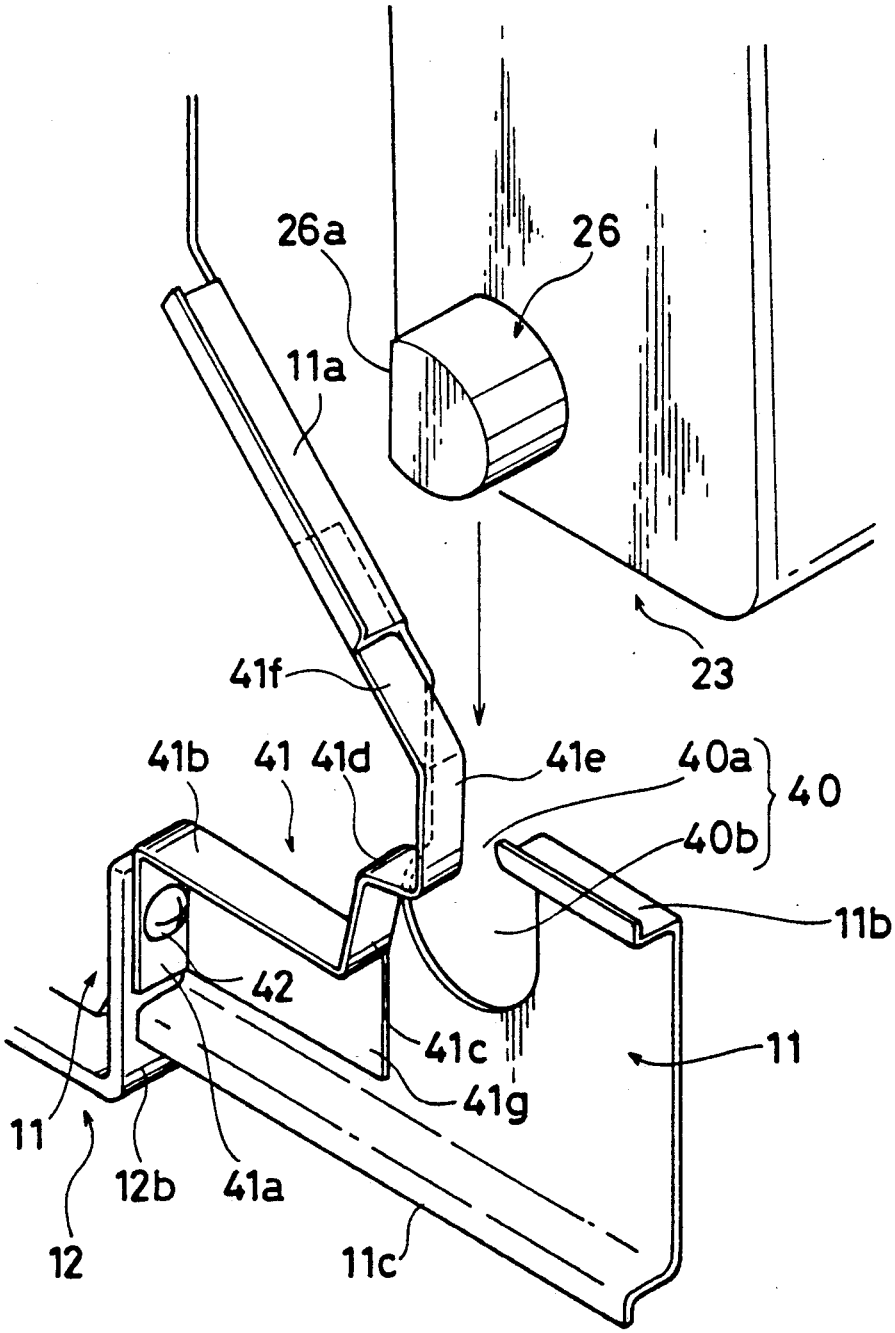
FIG. 5 is a perspective view showing a structure for attaching a document tray to the feeder.

As shown in FIG. 5, the base portion 41*a* providing one end of the plate spring 41 is fastened to a portion 12*b* of the bottom plate 12 which portion is projected outward beyond the side plate 11, using a screw 42. The deflection restraining portion 41*g* has a side edge in contact with the projected portion 12*b*. The other end of the plate spring 41, i.e., the engaged portion 41*f*, is a free end and is in bearing contact with the rib 11*a* of the side plate 11, whereby the plate spring 41 is prevented from moving in a direction toward which the spring stretches from the position shown in FIG. 5 (with clockwise movement of the engaged portion 41*f* in FIG. 5). With the portion 41*f* thus engaged by the rib ll*a*, the rotation restraining portion 41*d* and the second upright portion 41*e* are positioned inwardly of the cutout 40 when seen in side elevation.

The document tray 23 is attached to the side plates 11 in the following manner by the structure described above. First, the tray 23 is positioned upright as seen in FIG. 5 for the end portions of the pivots 26 to have the first width bl, and the pivots 26 are inserted into the respective cutouts 40 in this state. Although the periphery of the pivot 26 at the front side comes into contact with the plate spring 41 at this time, the spring 41 is deflected leftward in FIG. 5 by pushing the tray 23 downward against the force of the spring, whereby the pivot 26 is allowed to pass through the inlet portion 40*a* to eventually fit into the support portion 40*b* as seen in FIG. 6.

The horizontal portion 41*b* of the plate spring 41 is prevented from deflecting downward by the contact of one edge of the deflection restraining portion 41*g* with the bottom plate portion 12*b* projecting outward beyond the side plate 11, so that the pivot 26 at the front side is allowed to pass through the inlet portion 40*a* chiefly by the leftward deflection of the first, upright portion 41*c* in FIG. 6.

Figure 7:
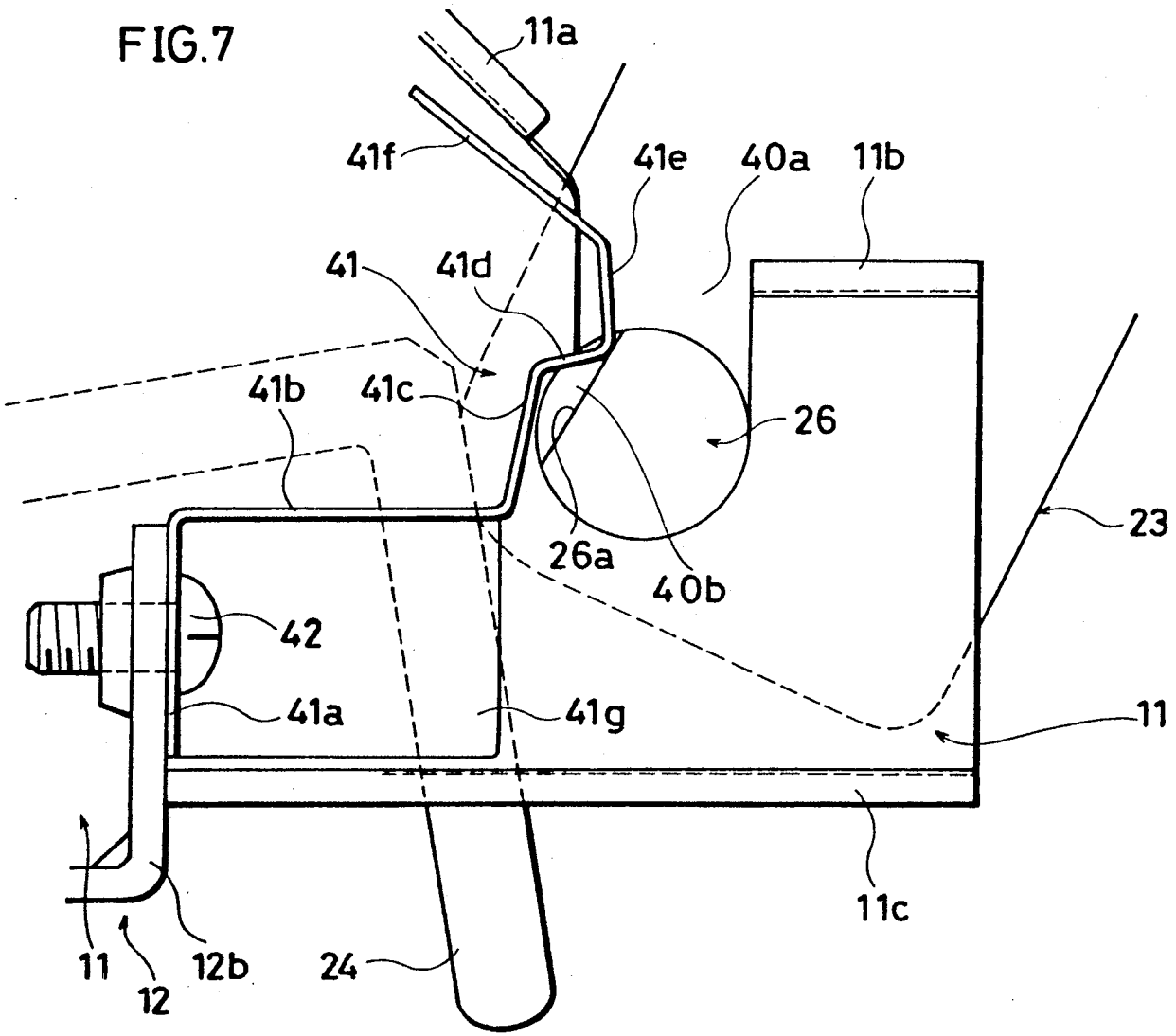

Next, the document tray 23 in this state is rotated clockwise in FIG. 6, whereby the tray 23 is brought to the position shown in FIG. 7 and then to the position (unfolded position) shown in FIG. 8. In the unfolded position, the downstream end of the document tray 23 bears against the straight extension 24*d* of the document guide member 24, whereby the tray 23 is held in the unfolded position against further rotation and made ready for use. With the tray 23 in the unfolded position, the plate spring 41 is returned to the position in which it is lowest in the energy of elasticity, and the rotation restraining portion 41*d* is in bearing contact with the D-cut face 26*a*. Consequently, the tray 23 is restrained from moving from the unfolded position to the upright position by the force of the spring 41.

Conversely, the document tray 23 is easily removable by moving the tray 23 from the unfolded position to the upright position against the elastic force of the plate spring 41, subsequently drawing out the pivot 26 at the rear side from the corresponding cutout 40 at the rear side where the spring 41 is not provided, and thereafter withdrawing the other pivot 26 directly from the support portion 40*b* of the other cutout 40 sidewise (obliquely upwardly rightward in FIG. 5).

If the structure described above has no plate spring 41, the document tray 23 is readily movable by a small external force, so that when the automatic document feeder 5 is quickly opened from its closed state, the force of inertia will inadvertently move the tray 23 greatly from the unfolded position to the upright position. When the tray 23 is thus moved to the upright position, the pivot 26 is likely to slip off the cutout portion 40 to allow the tray 23 to fall off in its entirety. The plate spring 41 therefore holds the tray 23 attached with higher stability, preventing the tray 23 from falling off the document feeder 5.

Accordingly, the plate spring 41 or like elastic member is provided in the vicinity of one or both of the cutouts 40. With the embodiment described, the plate spring 41 is provided in the vicinity of the cutout 40 at the front side, i.e. at one side of the automatic document feeder 5 remote from the other side thereof where the pivot of the feeder is disposed. If the feeder 5 is pivotally moved to its opened position in this case with the document tray 23 in its upright position, the plate spring 41 holds the frontside pivot 26 in engagement therewith without allowing the pivot to slip off the cutout portion 40. Moreover, the tray 23 is removable more easily than when the plate spring 41 is provided in the vicinity of each of the cutouts 40. The present structure is therefore advantageous. It is very useful to prevent the pivot 26 from slipping off since it will readily slip off when the automatic document feeder is opened with the document tray in its upright position.

Figure 12:
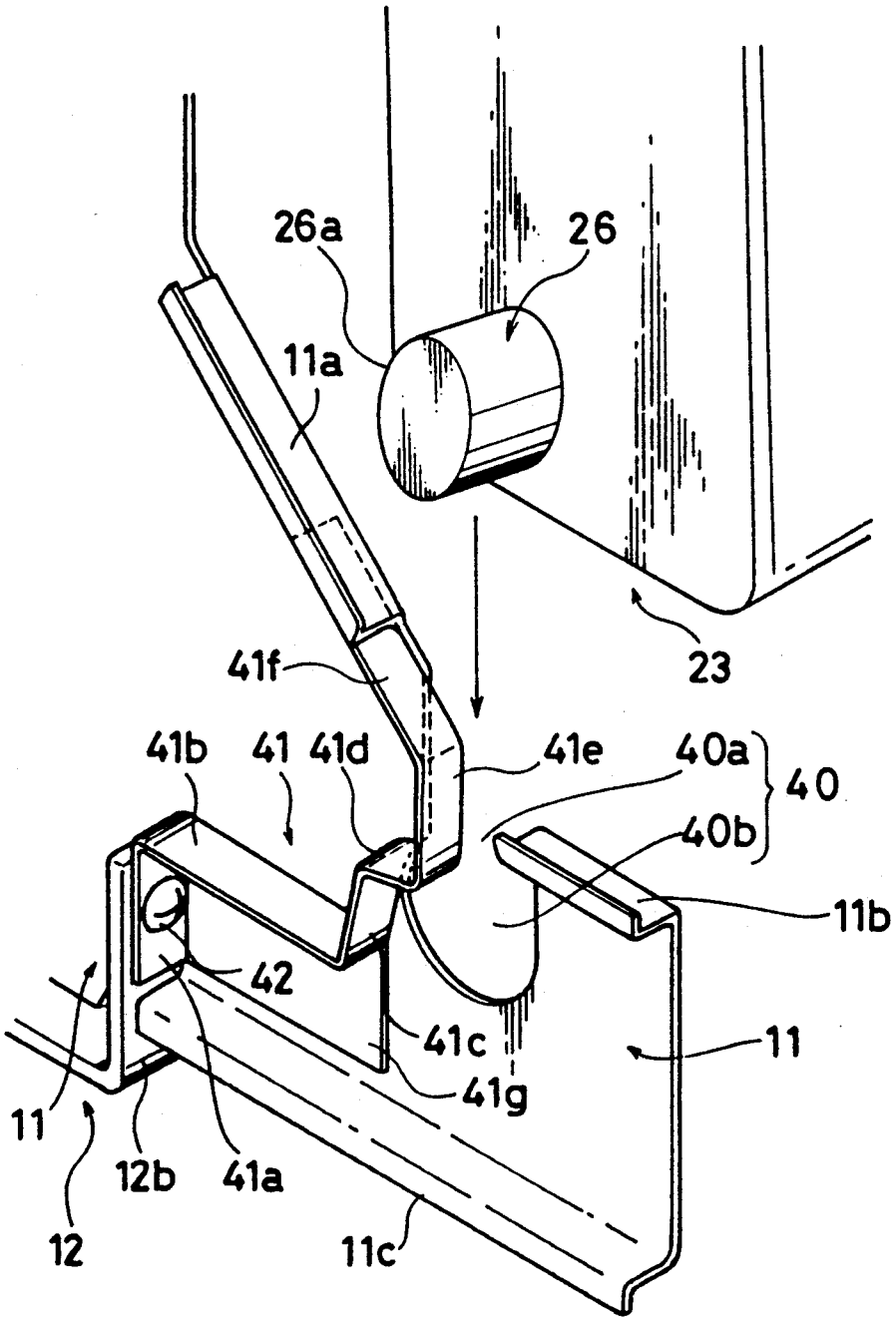
FIGS. 12 and 13 are perspective views showing two other attaching structures.
Figure 13:
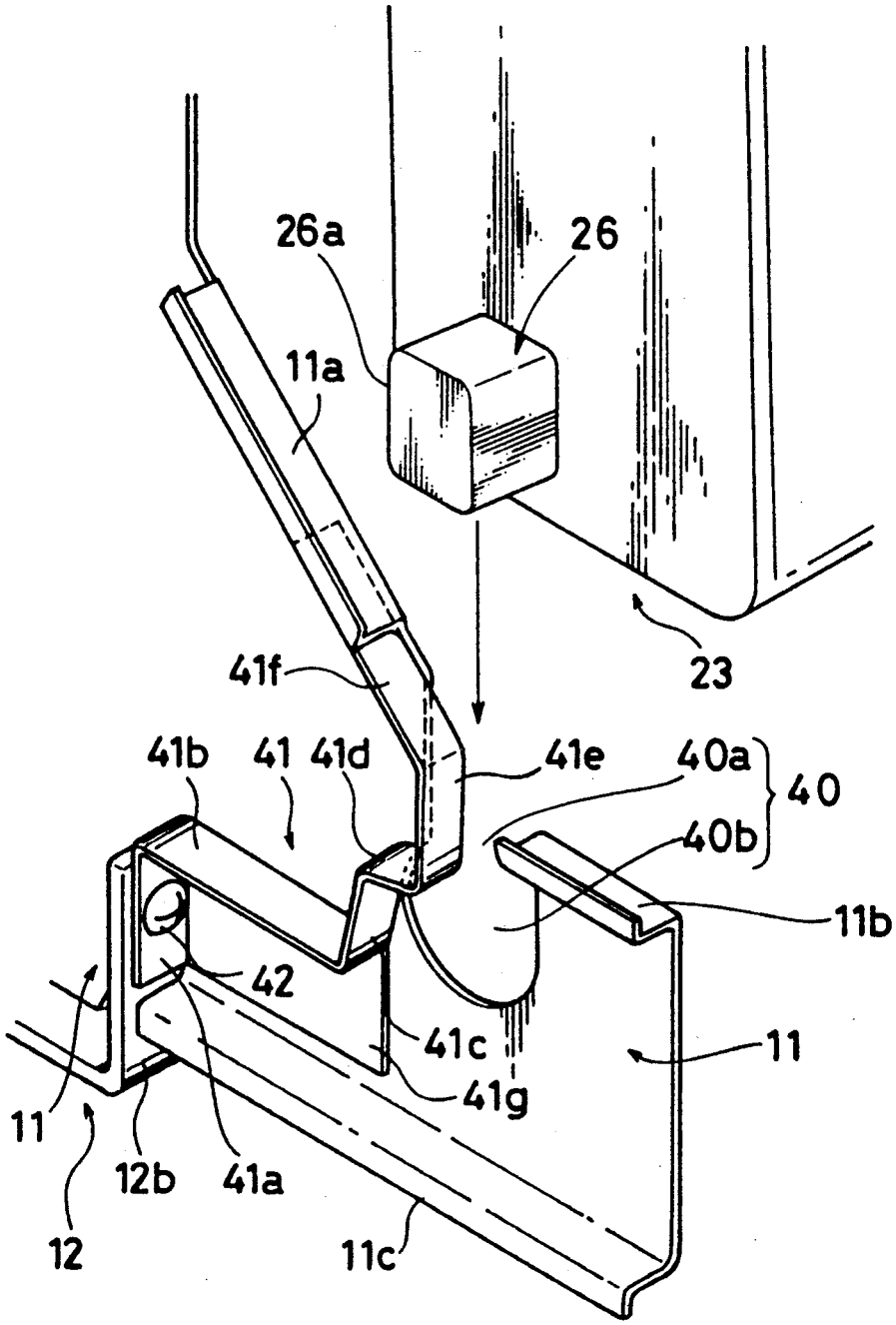

According to the present invention, the elastic member and the pivot 26 are not limited specifically in shape. For example, in cross section, the pivot 26 may be in the form of an ellipse having a major axis and a minor axis shown in FIG. 12, or a rectangle having long sides and short sides as shown in FIG. 13.

Figure 14:
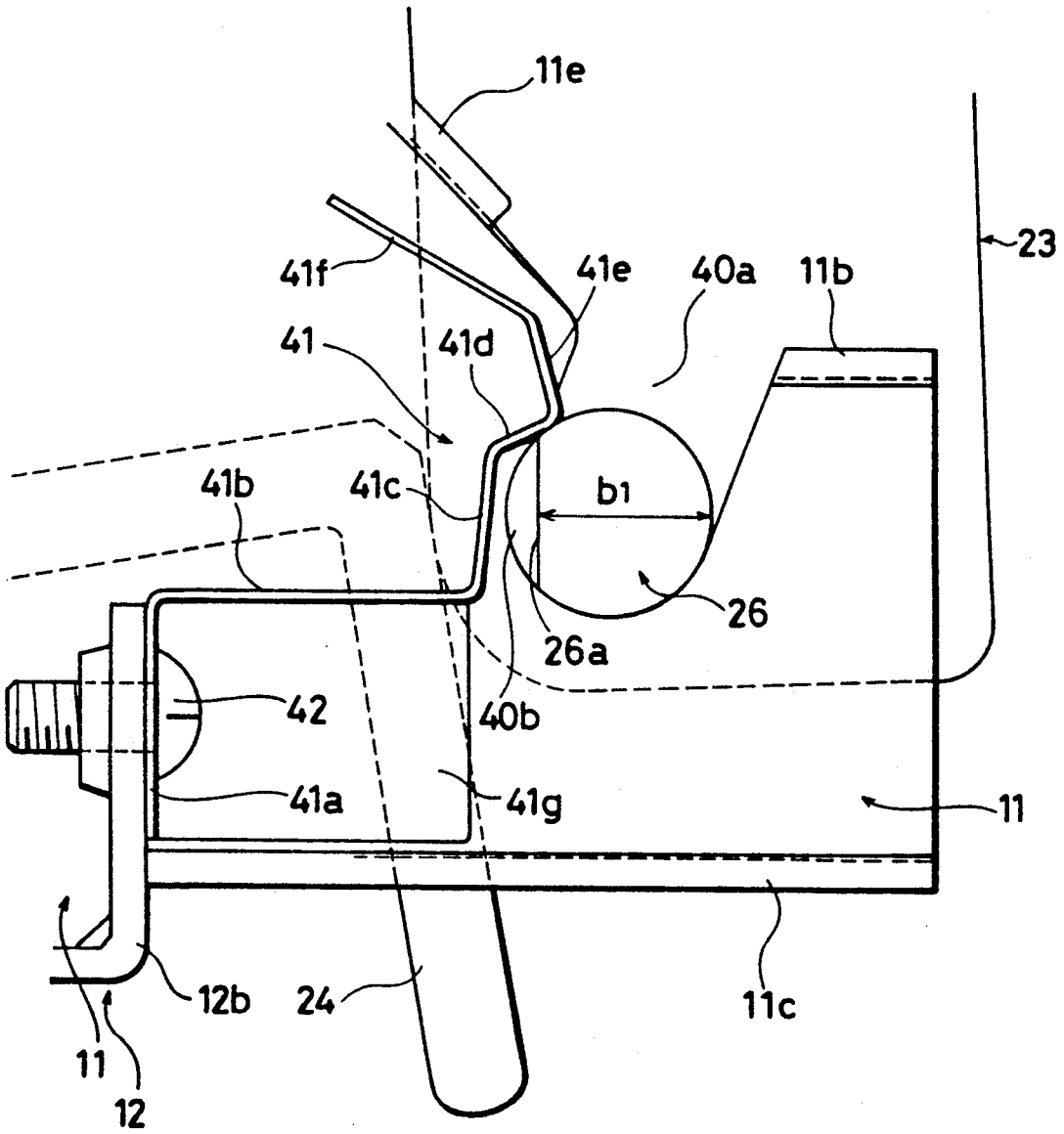
FIGS. 14 and 15 are fragmentary front views of two other attaching structures.
Figure 15:
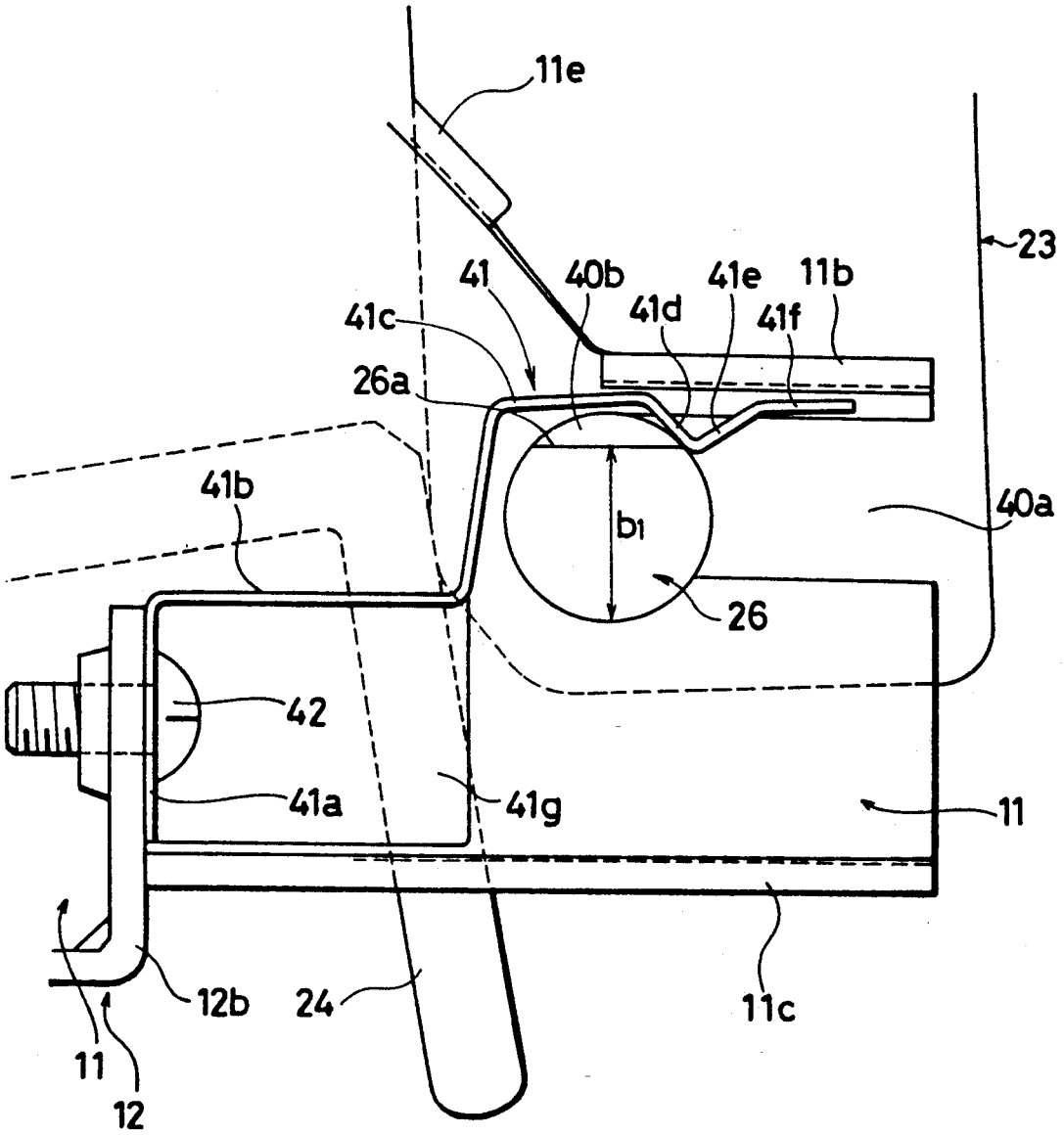

Although the pivot 26 is inserted into the cutout 40 from above according to the above embodiment, the direction of insertion of the pivot is not limited specifically with the present invention. For example, the cutout may be opened obliquely as shown in FIG. 14 or sideways as shown in FIG. 15 for the pivot to be inserted thereinto from this direction.

Although the structure of the present embodiment is adapted to attach the document tray 23 to the automatic document feeder 5, the present invention is applicable to sheet trays which are to be attached to the bodies of various apparatus, for example, to document discharge trays for automatic document feeders, and paper feed trays or paper discharge trays for apparatus, such as copying machines of the clamshell type, having an openable body. The same advantages as above can then be obtained.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. In a sheet transport device having a sheet tray removably attachable to the body of an apparatus pivotally movably to an upright position or an unfolded position, a sheet tray attaching structure characterized in that:

the sheet tray has pivots projecting from the respective opposite sides of the base end of the sheet tray and each having a first width when the sheet tray is in the upright position and a second width larger than the first width when the sheet tray is in the unfolded position, the apparatus body having cutouts opened for the respective pivots, each of the cutouts having an inlet portion having a width larger than the first width and smaller than the second width and a support portion having a diameter not smaller than the second width, an elastic member being provided in the vicinity of at least one of the cutouts for restraining the pivot as positioned in the support portion from rotating from the unfolded position to the upright position by contacting the pivot.

2. A sheet transport device as defined in claim 1 wherein the sheet tray is the document feed tray to be attached to the paper feed assembly of an automatic document feeder.

3. A sheet transport device as defined in claim 1 wherein the sheet tray is the document discharge tray to be attached to the document discharge portion of an automatic document feeder.

4. A sheet transport device as defined in claim 1 wherein the sheet tray is the paper feed tray to be attached to the body of a copying machine.

5. A sheet transport device as defined in claim 1 wherein the sheet tray is the paper discharge tray to be attached to the body of a copying machine.

6. A sheet transport device as defined in claim 1 wherein the pivot has a circular, cross section partly cut out.

7. A sheet transport device as defined in claim 6 wherein the elastic member is positioned to contact the cutout face of the pivot.

8. A sheet transport device as defined in claim 1 wherein the pivot has an elliptical cross section.

9. A sheet transport device as defined in claim 1 wherein the pivot has a rectangular cross section.

10. A sheet transport device as defined in claim 1 wherein the inlet portion of the cutout is open upward.

11. A sheet transport device as defined in claim 1 wherein the inlet portion of the cutout is open in an oblique direction.

12. A sheet transport device as defined in claim 1 wherein the inlet portion of the cutout is open sideways.

13. A sheet transport device as defined in claim 1 wherein the inlet portion of the cutout is straight.

14. A sheet transport device as defined in claim 1 wherein the support portion of the cutout is circular.

15. A sheet transport device as defined in claim 1 wherein the elastic member is provided in the vicinity of only one of the cutouts.

16. A sheet transport device as defined in claim 15 wherein the elastic member is provided in the vicinity of the cutout at one side of the apparatus body away from the pivot thereof.

17. A sheet transport device as defined in claim 1 wherein the elastic member comprises a plate spring having one end secured to the apparatus body and the other end in the form of a free end.

* * * * *